United States Patent [19]

Hamada et al.

[11] Patent Number: 4,833,069

[45] Date of Patent: May 23, 1989

[54] SILVER HALIDE COLOR PHOTOGRAPHIC LIGHT-SENSITIVE MATERIAL COMPRISING A SPECIFIED CYAN COUPLER COMBINATION AND TOTAL FILM THICKNESS

[75] Inventors: Fumio Hamada; Yoshitaka Yamada; Kiyotoshi Yamashita, all of Hino, Japan

[73] Assignee: Konishiroku Photo Industry Co., Ltd., Tokyo, Japan

[21] Appl. No.: 5,097

[22] Filed: Jan. 20, 1987

[30] Foreign Application Priority Data

Jan. 23, 1986 [JP] Japan ..... 61-12851

[51] Int. Cl.[4] ..... G03C 1/46; G03C 1/08

[52] U.S. Cl. ..... 430/496; 450/504; 450/505; 450/552; 450/553; 450/543

[58] Field of Search ..... 430/496, 504, 505, 553, 430/552, 543

[56] References Cited

U.S. PATENT DOCUMENTS

| | | | |
|---|---|---|---|
| 4,004,929 | 1/1977 | Davis | 430/549 |
| 4,389,479 | 6/1983 | Bishop et al. | 430/216 |
| 4,460,680 | 7/1984 | Ogawa et al. | 430/496 |
| 4,584,264 | 4/1986 | Ohki et al. | 430/542 |
| 4,594,314 | 6/1986 | Kimura et al. | 430/553 |
| 4,690,888 | 9/1987 | Fujnahara et al. | 430/549 |
| 4,707,434 | 10/1987 | Koboshi et al. | 430/393 |

OTHER PUBLICATIONS

Wolfe et al, "Determination of the Modulation, . . . ", 9/68, Journal of the Optical Society of America, pp. 1245–1255.

*Primary Examiner*—Paul R. Michl
*Assistant Examiner*—Patrick A. Doody
*Attorney, Agent, or Firm*—Jordan B. Bierman

[57] ABSTRACT

A silver halide color photographic light-sensitive material is disclosed. The material is improved in a developing stability, whose red density-green density balance is hardly affected even by change in a developing condition. The photographic material comprises a support and, provided on a side of the support, at least one red-sensitive silver halide emulsion layer and at least one green-sensitive silver halide emulsion layer. The total thickness of the layers provided on the emulsion coated side of the suport, is within the range of from 5 to 18 μm. The red-sensitive emulsion layer contains a cyan-dye forming coupler and a clored cyan-dye forming coupler, and a ratio of the colored cyan-dye forming coupler to the total amount of the cyan-dye forming coupler and the colored cyan-dye forming coupler is within the range of from 15 to 80 mol %.

5 Claims, No Drawings

SILVER HALIDE COLOR PHOTOGRAPHIC LIGHT-SENSITIVE MATERIAL COMPRISING A SPECIFIED CYAN COUPLER COMBINATION AND TOTAL FILM THICKNESS

FIELD OF THE INVENTION

The present invention relates to a silver halide multilayered color photographic light-sensitive material, and more particularly to a silver halide multilayered color photographic light-sensitive material (hereinafter referred to as color light-sensitive material) which is improved in the development stability as well as in the image sharpness.

BACKGROUND OF THE INVENTION

In general, a color light-sensitive material has on the support thereof a red-sensitive silver halide emulsion layer containing a cyan color-forming coupler, a green-sensitive silver halide emulsion layer containing a magenta color-forming coupler, and a blue-sensitive silver halide emulsion layer containing a yellow color-forming coupler, and additionally other necessary layers such as antihalation layer, interlayer, filter layer, protective layer and the like.

In recent years, there has been strongly proposed the development of color light-sensitive materials more improved in the film speed and image sharpness. As the method of improving the image sharpness there are conventionally known a method in which the thickness of the emulsion layer of a color light-sensitive material is reduced to minimize the light scatter caused by the silver halide crystals of the emulsion layer and by others, another method in which materials (such as dyes, UV-absorbing agents) to absorb an undesirable light in a specific spectral region are added to the emulsion for improving the image sharpness, and equivalent other methods.

The thickness of the emulsion layer of a color light-sensitive material is generally from 20 to 30μ. However, if the thickness is reduced to 18μ or smaller, there occurs the disadvantage that the red and green densities become ill balanced due to the changes in developing conditions (such as developing temperature, time, agitation) and in the developer composition (such as the concentration of the color developing agent used, pH, halide ion concentration), and thus the thickness reduction has its limits.

The red density and green density are formed by the coupling reaction of the oxidized product of a developing agent with the cyan coupler contained mainly in the red-sensitive emulsion layer and the magenta coupler mainly in the green-sensitive emulsion layer, respectively, but, if the red density and green density are changed to be out of balance, when printing is made by, for example, an automatic printer well known to those in the art, the same printing condition cannot be applied, which constitutes a serious shortcoming in the procedure of the printing operation.

SUMMARY OF THE INVENTION

It is an object of the present invention to provide a color light-sensitive material which is improved in the image sharpness and also in the developing stability; i.e., whose red density-green density balance is hardly affected even by changes in the developing condition.

The above object is accomplished by a silver halide color photographic light-sensitive material comprising a support having, on a side thereof, plural layers including at least one red-sensitive silver halide emulsion layer and at least one green-sensitive silver halide emulsion layer, in which the total thickness in a dry state of the plural layers is within the range of from 5 to 18 μm, and the red-sensitive silver halide emulsion layer contains a cyan-dye forming coupler and a colored cyan-dye forming coupler and a ratio of the colored cyan dye-forming coupler to the total amount of the cyan dye-forming coupler and the colored cyan dye-forming coupler is within the range of from 15 to 80 mole %.

It is a conventionally known technique that such colored cyan couplers are applied to a color light-sensitive material with the purpose of compensating the color-purity deterioration induced by the unfavorable secondary absorption behavior of dyes formed of other couplers and a quantity of the colored cyan couplers used is to be not more than 15% of an aggregate quantity of the whole cyan couplers used.

This invention has been achieved in view of the newly discovered fact that, in the quantity range of such colored cyan couplers used of from 15 to 80%, that is different from the conventional range, such cyan couplers can display a remarkable effect of improving a development instableness which may occur when the thickness of a light-sensitive material is made not thicker than 18 μm, besides the above-mentioned colo compensation effect.

In addition, a large quantity of such colored cyan couplers will practically bring light-sensitive materials in a reproduced color sharpness as well as an excellent color reproduction.

DETAILED DESCRIPTION OF THE INVENTION

Reducing the total dry thickness of all the hydrophilic colloid layers provided on the side of the red-sensitive emulsion layer and green-sensitive emulsion layer (hereinafter referred to as the emulsion-side layer-thickness) is limited by the silver halide emulsion, couplers, oily agents, additives and the like, contained therein. The preferred emulsion-side layer-thickness is from 5 μm to 18 μm, and more preferably from 10 μm to 16 μm. It is difficult to manufacture the emulsion-side layers having a total dry thickness less than 5 μm is difficult.

It is preferable to be not more than 14 μm in thickness from the uppermost surface of the emulsion-side layers to the bottom-side of the emulsion layer closest to the support. It is also preferable to be not more than 10μm in thickness from the above-mentioned uppermost surface to the bottom-side of the emulsion layer which is the next closest to the support and has a different color-sensitivity from that of the emulsion layer closest to the support.

As a method of reducing the thickness of the color light-sensitive material of this invention there is a method for reducing the amount of a hydrophilic colloid as the binder. Since the hydrophilic colloid is incorporated for the purpose of protecting the coupler's fine oily particles in the silver halide or high boiling solvents, of preventing the silver halide from an increase in fog due to mechanical stress, or of preventing the color turbidity caused by the inter-layer diffusion of the oxidized product of a color developing agent, the method is capable of reducing the thickness to an extent not to impair such purposes.

As another method of reducing the thickness there is a method of using highly color-formable couplers.

Examples of the highly color-formable coupler advantageously usable in this invention include two-equivalnt couplers, such as those two-equivalent yellow couplers as described in, e.g., Japanese Patent Publication Open to Public Inspection (hereinafter referred to as Japanese Patent O.P.I. Publication) Nos. 115219/1977 and 12338/1979, those two-equivalent magenta couplers as described in, e.g., Japanese Patent O.P.I. Publication Nos. 123129/1978 and 118034/1980, and those two-equivalent cyan couplers as described in, e.g., Japanese Patent O.P.I. Publication Nos. 105226/1978 and 14736/1979. The highly color-formable couplers advantageously usable in this invention also include polymer couplers such as, for example, those polymer couplers as described in, e.g., Japanese Patent Examined Publication No. 22513/1971, U.S. Pat. Nos. 3,767,412 and 3,926,436, and Japanese Patent O.P.I. Publication No. 28745/1983.

Other methods for reducing the thickness include a method of reducing the using amount of a high-boiling solvent and a method in which a scavenger of the oxidized product of a developing agent is added to the interlayer between different color sensitivity-having layers to thereby reduce the thickness of the interlayer.

Examples of the cyan coupler to be used in the red-sensitive emulsion layer of the color light-sensitive material of this invention include so-called colorless couplers, colored couplers, DIR couplers and the like.

The red-sensitive emulsion layer may be either a single layer or a plurality of layers, but where it is comprised of two or more emulsion layers different in the sensitivity, the molar ratio of the colored coupler to all the cyan couplers contained in the highest-sensitivity layer is desirable to be from 15% to 80%.

In the present invention, the molar ratio of the colored coupler to all the cyan couplers in each red-sensitive emulsion layer is from 15% to 80%, preferably from 20% to 70%, and more preferably from 25% to 60%.

The total amount of all the cyan couplers to be used in the red-sensitive emulsion layer is from 0.01 to 0.20 mole to the silver halide of the emulsion layer.

Where the emulsion layer is constituted by two or more emulsion layers different in the sensitivity, the total amount of the cyan couplers of the highest-sensitivity emulsion layer is to be from 0.01 to 0.10 mole, and desirable to be used in a smaller amount than that to be used in the other layers.

The cyan coupler may be incorporated into a non-light-sensitive layer adjacent to the red-sensitive emulsion layer. The ratio of the colored coupler to all the cyan couplers in the nonlight-sensitive layer is desirable to be from 15 to 80% (molar ratio).

The colored coupler to be used in this invention may be either a magenta-colored cyan coupler or yellow-colored cyan coupler, but the use of the magenta-colored cyan coupler is more desirable.

The cyan couplers (colorless coupler, colored coupler, DIR coupler, etc.) to be used in this invention may be incorporated with an emulsion or a hydrophilic colloid solution by the dispersion method well-known to those skilled in the art. For example, the incorporation may be made in the manner that the coupler is dissolved into a mixture of a high-boiling solvent such as, e.g., dibutyl phthalate, dioctyl phthalate, tricresyl phosphate, etc., with a low-boiling solvent such as ethyl acetate, acetone, etc.; the solution is added to a mixture of a surface active agent such as a sodium alkylnaphthalene, sodium benzenesulfonate, etc., with an aqueous gelatin solution; the resulting mixture is then emulsified by means of a colloid mill; and the emulsified product is subsequently incorporated into the emulsion or the hydrophilic colloid solution.

The colored cyan couplers of this invention are those having the following general formula [I]:

Formula [I]

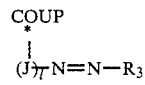

wherein COUP is a cyan coupler residue, * represents the coupling position of the cyan coupler, J is a divalent linkage group, l is zero or 1, and $R_3$ is an aryl group.

The cyan coupler residue represented by the COUP includes phenol-type coupler residues and naphthol-type coupler residues, and more preferably naphthol-type coupler residues.

Those preferred as the divalent linkage group represented by the J have the following general formula [II]:

Formula [II]

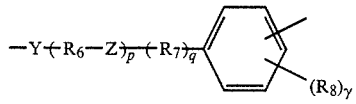

wherein $R_6$ is an alkylene or arylene group having from 1 to 4 carbon atoms, and $R_7$ is an alkylene group having from 1 to 4 carbon atoms, provided that the alkylene group represented by the $R_6$ or $R_7$ may be substituted by an alkyl, carboxyl, hydroxy or sulfo group, Z represents a

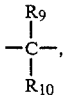

—O—, —S—, —SO—, —$SO_2$—, —$SO_2$NH—, —conh—, —COO—, —NHCO—, —$NHSO_2$—, or —OCO—, and $R_9$ and $R_{10}$ each is an alkyl or aryl group, $R_8$ is a hydrogen atom, an alkyl group, an aryl group, a heterocyclic group, a hydroxy group, a cyano group, a nitro group, an alkoxy group, an aryloxy group, a carboxy group, a sulfo group, a halogen atom, a carbonamido group, a sulfonamido group, a carbamoyl group, an alkoxycarbonyl group or a sulfamoyl group.

Reference character p is zero or a positive integer, q is zero or 1, and $\gamma$ is an integer of from 1 to 4; provided that when p is not less than 2, the $R_6$s and Zs may be either the same or different, respectively, and when the $\gamma$ is not less than 2, the $R_8$s may be either the same or different.

The aryl group represented by the $R_3$, when l= zero, is desirable to be a phenyl group and naphthyl group. The phenyl group and naphthyl group each may have a substituent. Examples of the substituent include halogen atoms, alkyl, alkoxy, aryloxy, hydroxy, acyloxy, carboxyl, alkoxycarbonyl, aryloxycarbonyl, mercapto, alkylthio, arylthio, alkylsulfonyl, arylsulfonyl, acyl, acylamino, sulfonamido, carbamoyl, sulfamoyl and the like groups.

When l=1, the preferred aryl group represented by the $R_3$ includes those naphthol groups having the following general formula [III]:

Formula [III]

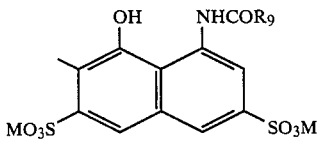

wherein $R_9$ is a straight-chain or branched-chain alkyl group having from 1 to 4 carbon atoms (such as methyl, ethyl, propyl, isopropyl, butyl, sec-butyl, t-butyl, etc.), and M is a photographically inert cation such as, e.g., of hydrogen, alkali metal like sodium or potassium, ammonium, methyl ammonium, ethyl ammonium, diethyl ammonium, triethyl ammonium, ethanol ammonium, diethanol ammonium, pyridinium, piperidium, anilinium, toluidinium, p-nitroanilinium, anisidium, and the like.

The following are examples representative of the colored coupler having Formula [I], but are not limited thereto.

CC-1

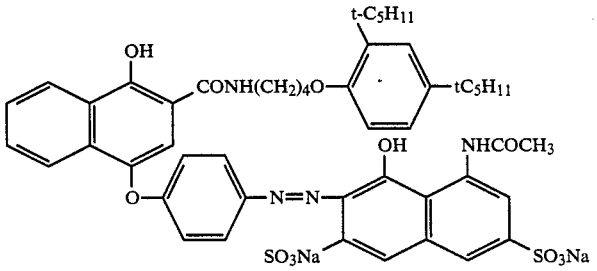

CC-2

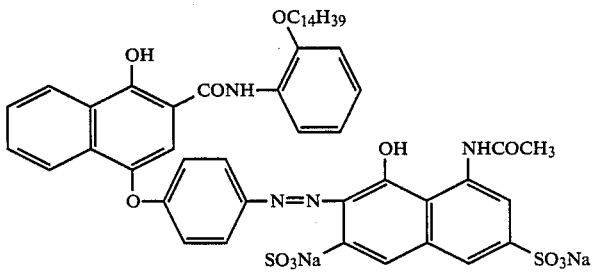

CC-3

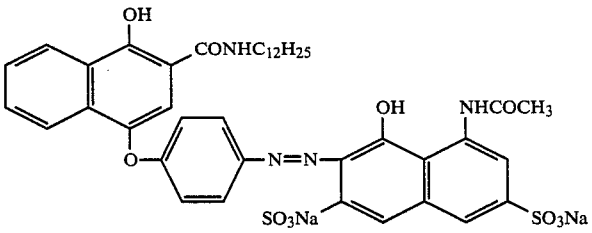

CC-4

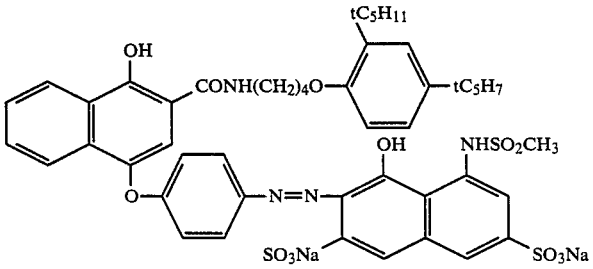

-continued
CC-5
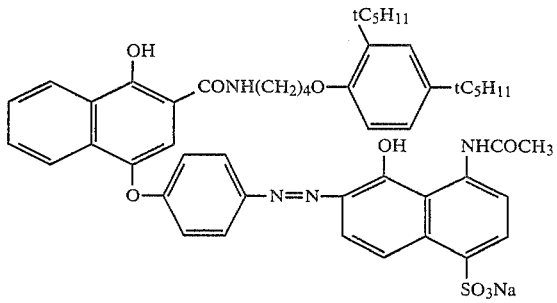
CC-6
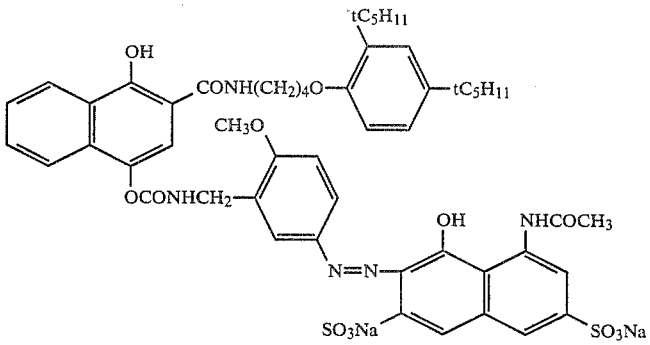
CC-7
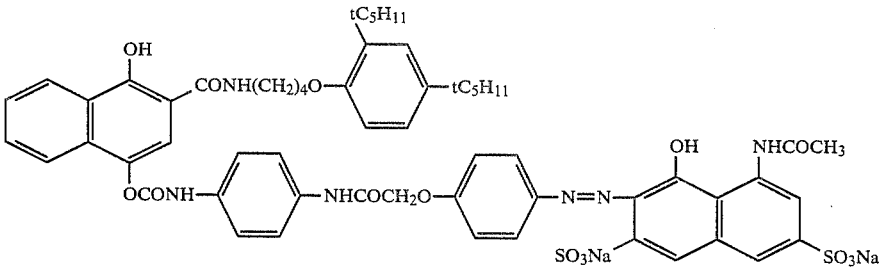
CC-8
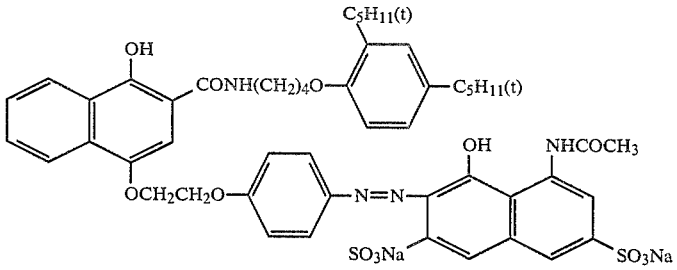
CC-9
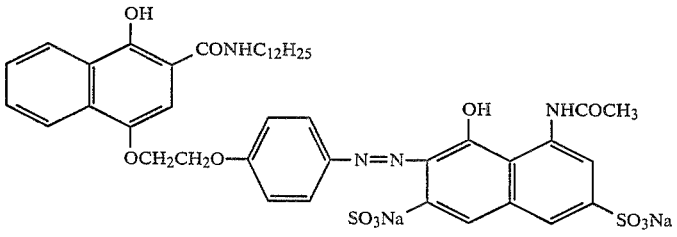

-continued

CC-10

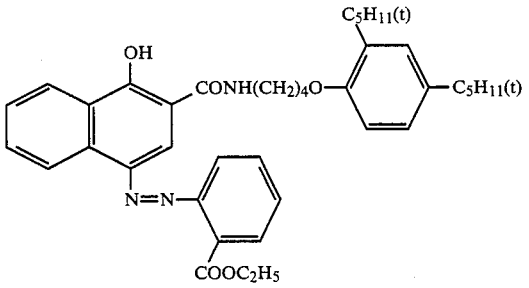

CC-11

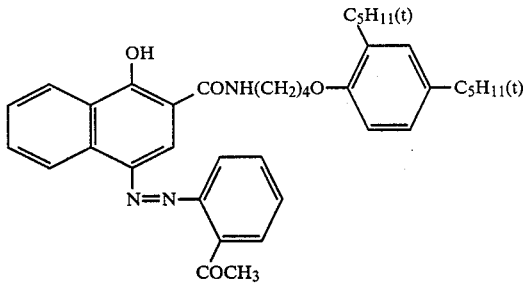

CC-12

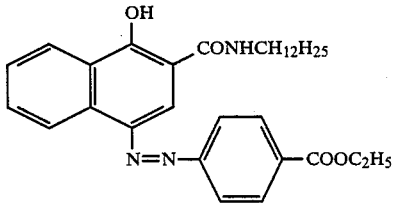

CC-13

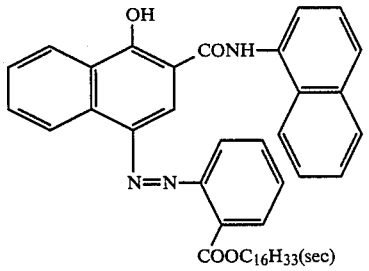

CC-14

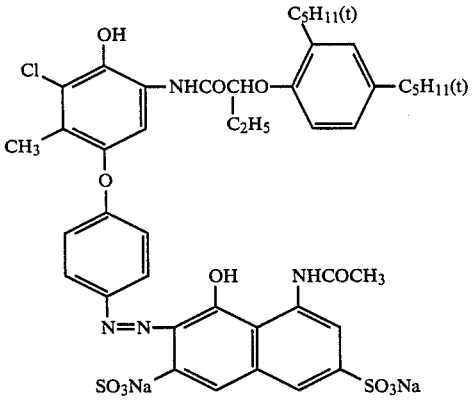

The above compounds may be synthesized in accordance with those methods described in Japanese Patent O.P.I. Publication Nos. 123341/1975, 65957/1980 and 94347/1981, Japanese Patent Examined Publication Nos. 11304/1967, 32461/1969, 17899/1973 and 34733/1978, U.S. Pat. No. 3,034,892, and British Pat. No. 1,084,480, and the like.

The cyan couplers of this invention are phenol-type couplers and naphthol-type couplers, and the preferred ones of them are those couplers having the following general formulas [IV], [V] and [VI]:

Formula [IV]

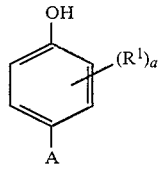

Formula [V]

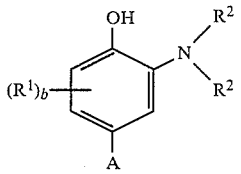

Formula [VI]

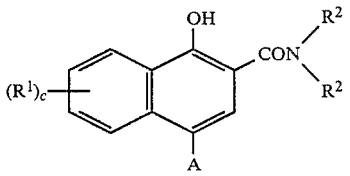

In the above formulas, A is a hydrogen atom or a group splittable by the reaction with the oxidized product of a color developing agent, $R^1$, $R^2$ and $R^3$ each is a group that can be used in ordinary phenol or α-naphthol couplers; to be more concrete, $R^1$ is a hydrogen atom, a halogen atom, an alkoxycarbonylamino an aliphatic hydrocarbon residue, an N-arylureido group, an acylamino group, —O—$R^4$ or —S—$R^4$, wherein $R^4$ is an aliphatic hydrocarbon residue), provided that where two or more $R_7$s are present in the same molecule, the two or more $R^1$s may be either the same or different, and the aliphatic hydrocarbon residue includes those having substituents.

Where these substituents contain aryl groups, the aryl group may have an alkyl, alkenyl, cycloalkyl, aralkyl, cycloalkenyl, halogen, nitro, cyano, aryl, alkoxyl, aryloxy, carboxy, alkoxycarbonyl, aryloxycarbonyl, sulfo, sulfamoyl, carbamoyl, acylamino, diacylamino, ureido, urethane, sulfonamido, heterocyclic, arylsulfonyl, alkylsulfonyl, arylthio, alkylthio, alkylamino, dialkylamino, anilino, N-alkylanilino, N-arylanilino, N-acylanilino, hydroxy, mercapto or the like group.

The $R^2$ and $R^3$ each is a group selected from the class consisting of aliphatic hydrocarbon residues, aryl groups, and heterocyclic residues, or either one of the $R^2$ and $R^3$ may be a hydrogen atom, or these groups include those having substituents. The $R^2$ and $R^3$ may also form a nitrogen-containing heterocyclic nucleus in cooperation with each other.

And the aliphatic hydrocarbon residue may be either saturated or unsaturated, straight-chain or branched-chain, or cyclic, and preferably an alkyl group such as methyl, ethyl, propyl, isopropyl, butyl, t-butyl, isobutyl, dodecyl, octadecyl, cyclobutyl, cyclohexyl, or an alkenyl group such as aryl, octenyl.

The aryl group includes a phenyl and naphthyl groups, and the heterocyclic residue is typified by pyridinyl, quinolyl, thienyl, piperidyl, imidazolyl and the like. Examples of the substituent introducible into these aliphatic hydrocarbon residues, aryl groups and heterocyclic residues include halogen atoms, nitro, hydroxy, carboxyl, amino, substituted amino, sulfo, alkyl, alkenyl, aryl, heterocyclic, alkoxy, aryloxy, arylthio, arylazo, acylamino, carbamoyl, ester, acyl, acyloxy, sulfonamido, sulfamoyl, sulfonyl, morpholino, and the like groups.

The split-off group represented by the A includes those arbitrary groups known as the split-off group of two-equivalent phenol-type cyan couplers and two-equivalent naphthol-type cyan couplers, and more preferably halogen atoms such as fluorine or chlorine, substituted or unsubstituted alkoxy groups such as methoxy, 2-methoxyethoxy, 3-carboxypropoxy or n-hexadecyloxy, substituted or unsubstituted aryloxy groups such as phenoxy, 1-naphthoxy, 4-methoxyphenoxy, 4-t-octylphenoxy, 4-methane-sulfonylphenoxy or 3-pentadecylphenoxy, substituted or unsubstituted heterocycloxy groups such as 2-pyridyloxy or 4,6-dimethoxy-1,3,5-triazine-2-yloxy, substituted or unsubstituted alkylthio groups such as methylthio, 2-methane-sulfonylethylthio or n-dodecylthio, substituted or unsubstituted arylthio groups such as phenylthio, 4-n-dodecylphenylthio or 2-methoxy-5-t-octylphenylthio, substituted or unsubstituted alkylsulfonyl groups such as methylsulfonyl, n-decyl-sulfonyl or 4-hydroxybutylsulfonyl, and substituted or unsubstituted heterocyclic groups such as 3-nitropyrazolyl, morpholino or 1-benzyl-5-ethoxyhydantoin-3-yl.

Of these the particularly preferred ones as the A include hydrogen, chlorine and fluorine atoms, and aryloxy, heterocylic oxy and alkoxy groups. The aryloxy group is particularly preferred.

The particularly preferred ones as the cyan coupler of this invention are those having the following general formula [VII]:

Formula [VII]

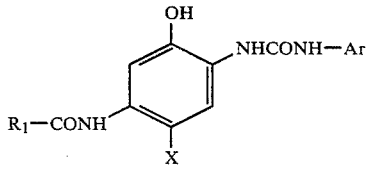

wherein $R_1$ is a substitutable alkyl, aryl or heterocyclic group, Ar is a substitutable aryl group, X is a hydrogen atom or a group splittable in the coupling reaction with the oxidized product of a color developing agent.

In Formula [VII] the $R_1$ represents a substitutable alkyl, aryl or heterocyclic group, and preferably an alkyl, aryl or heterocyclic group having from 1 to 30 carbon atoms; for example, a straight-chain or branched-chain alkyl such as 1-butyl, a-octyl, t-octyl, a-dodecyl or the like, alkenyl, or cycloalkyl group, or 5- or 6-member heterocyclic group or a group having the following general formula [VIII]:

Formula [VIII]

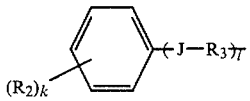

wherein J is an oxygen atom or a sulfur atom, K is an integer of from zero up to 4, l is zero or 1, provided that when K is not less than 2, the two or more $R_2$s may be either the same or different; $R_3$ is a straight-chain or branched-chain alkyl group having from 1 to 20 carbon atoms; $R_2$ is a monovalent group, such as, e.g., a hydrogen atom, a halogen atom, preferably chlorine or bromine, an alkyl group preferably a straight-chain or branched-chain alkyl having from 1 to 20 carbon atoms such as methyl, tert-butyl, tert-pentyl, tert-octyl, dodecyl, pentadecyl, benzyl or phenethyl, an aryl group such as phenyl, a heterocyclic group, preferably a nitrogen-containing heterocyclic grup, an alkoxy group, preferably a straight-chain or branched-chain alkyloxy group having from 1 to 20 carbon atoms such as methoxy, ethoxy, tert-butyloxy, octyloxy, decyloxy or dodecyloxy, an aryloxy group such as phenoxy, a hydroxy group, an acyloxy group, preferably an alkylcarbonyloxy or arylcarbonyloxy group such as acetoxy or benzoyloxy, a carboxy group, an alkoxycarbonyl group, preferably a straight-chain or branched-chain alkyloxycarbonyl group having from 1 to 20 carbon atoms, an aryloxycarbonyl group, preferably a phenoxycarbonyl group, an alkylthio group, preferably one having from 1 to 20 carbon atoms, an acyl group, preferably a straight-chain or branched-chain alkylcarbonyl group having from 1 to 20 carbon atoms, an acylamino group, preferably a straight-chain or branched-chain alkylcarbamido or benzene-carbamido group having from 1 to 20 carbon atoms, a sulfonamido group preferably straight-chain or branched-chain alkyl-sulfonamido or benzene-sulfonamido group having from 1 to 20 carbon atoms, a carbamoyl group, preferably a straight-chain or branched-chain alkylaminocarbonyl or phenylaminocarbonyl group having from 1 to 20 carbon atoms, a sulfamoyl group, preferably a straight-chain or branched-chain alkylaminosulfonyl or phenylaminosulfonyl group having from 1 to 20 carbon atoms, or the like.

The Ar is a substitutable aryl group, preferably a phenyl or naphthyl group, and more preferably a phenyl group. Preferred examples of the substituent include halogen atoms such as fluorine, chlorine or bromine, cyano, nitro, hydroxyl, substitutable alkyl, aryl, heterocyclic, alkylsulfonyl, arysulfonyl, alkoxy, aryloxy, acyl, alkoxycarbonyl, aryloxycarbonyl, sulfonamido, acylamino, amino, sulfamoyl, carbamoyl and acyloxy groups. Of these the particularly preferred substituents are halogen atoms, cyano, alkyl, alkylsulfonyl, arylsulfonyl and sulfonamido groups.

The X is a hydrogen atom or a group splittable in the coupling reaction with the oxidized product of a color developing agent, the group being such as, for example, a halogen atom such as fluorine, chlorine, bromine, a thiocyano group, a substitutable alkyloxy, aryloxy or heterocyclic oxy group, an alkylthio group, an arylthio group, heterocyclic thio group, an acyloxy group, a sulfonamido group, an alkylsulfonyl group, an arylsulfonyl group, an acyl group, heterocyclic group, phosphonyloxy group or an arylazo group. In addition, more concrete examples are found in U.S. Pat. No. 3,476,563, Japanese Patent O.P.I. Publication No. 37425/1972, Japanese Patent Examined Publication No. 36894/1973, Japanese Patent O.P.I. Publication Nos. 10135/1975, 117422/1975, 120334/1975, 130441/1975, 108841/1976, 18315/1977, 105226/1978, 14736/1979, 48237/1979, 32071/1980, 65957/1980, 1938/1981, 12643/1981 and 27147/1981.

Of these the preferred ones as the X are hydrogen, fluorine and chlorine atoms, and alkyloxy, aryloxy, heterocyclic oxy, alkylthio, arylthio and heterocyclic thio groups, and the most preferred ones as the X are alkyloxy and aryloxy groups.

The following are part of the preferred examples of the cyan dye forming couplers usable in this invention, but the present invention is not limited by the examples.

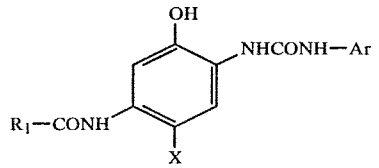
| No. | $R_1$ | Ar | X |
|---|---|---|---|
| C-1 | 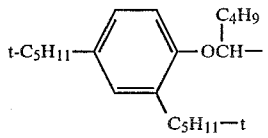 | 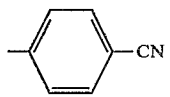 | —H |
| C-2 | 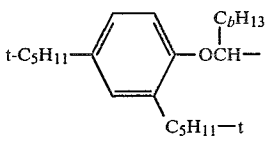 | 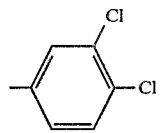 | 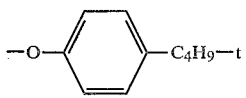 |
| C-3 | 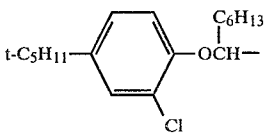 | 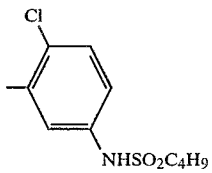 | —F |
| C-4 | 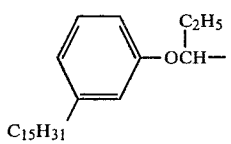 | 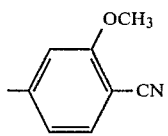 | 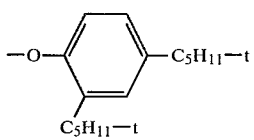 |
| C-5 | 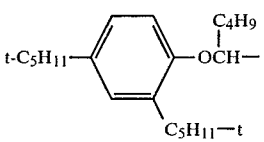 | 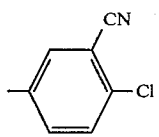 | 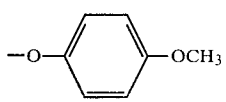 |

-continued
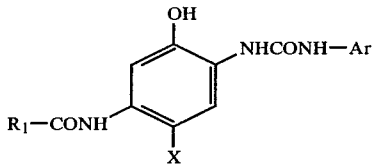
| | | | |
|---|---|---|---|
| C-6 | 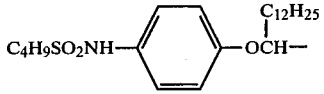 | 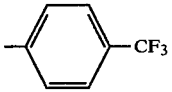 | —OCH2CONHC4H9—t |
| C-7 | 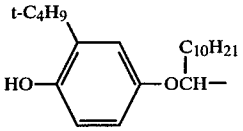 | 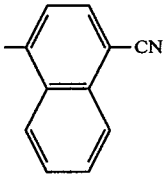 | 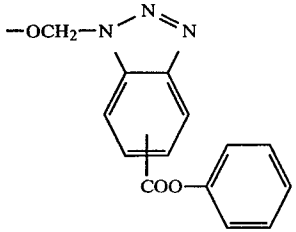 |
| C-8 | 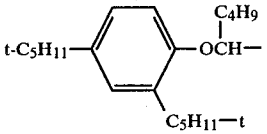 | 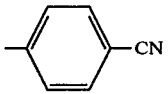 | 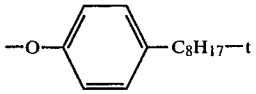 |
| C-9 | 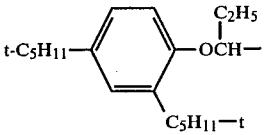 | 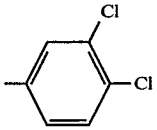 | —O—CH2CH2SCH2 COOH |
| C-10 | CH3— | 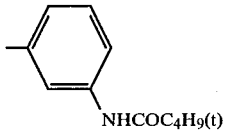 | OCH2CONH(CH2)4 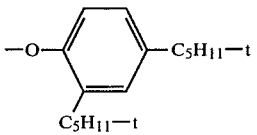 |

-continued
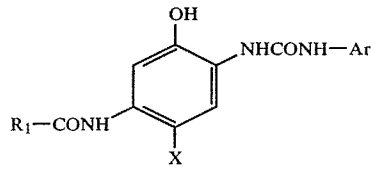
| | | | |
|---|---|---|---|
| C-11 | 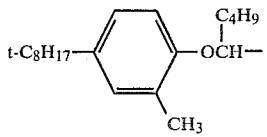 | 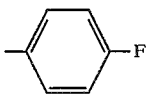 | —Cl |
| C-12 | 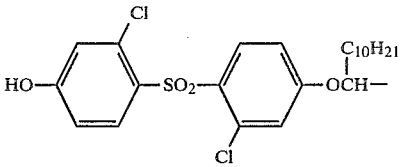 | 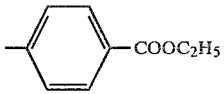 | 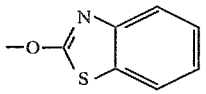 |
| C-13 | 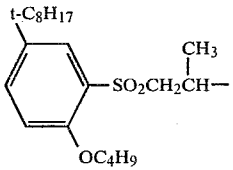 | 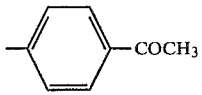 | 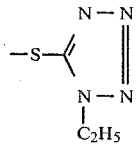 |
| C-14 | 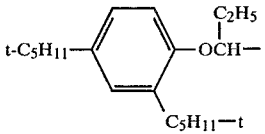 | 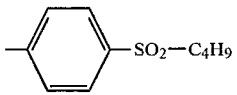 | —H |
| C-15 | 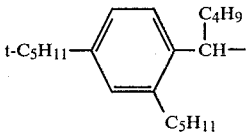 | 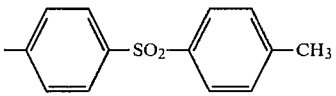 | —Cl |

-continued
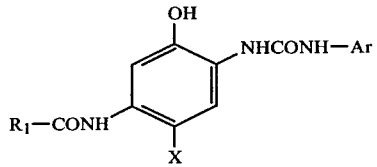
| | | | |
|---|---|---|---|
| C-16 | 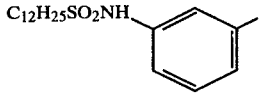 | 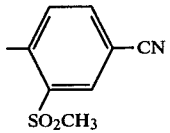 | —$OCH_3$ |
| C-17 | 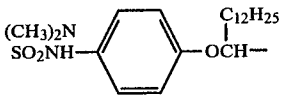 | 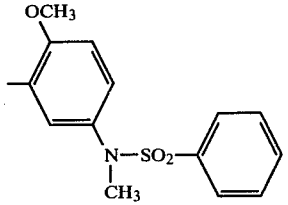 | 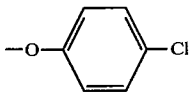 |
| C-18 | 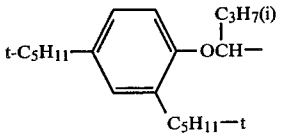 | 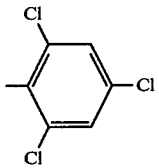 | —SCN |
| C-19 | $(CH_3)_3C$— | 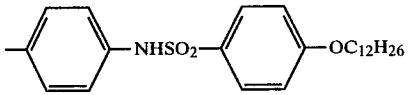 | 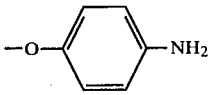 |
| C-20 | 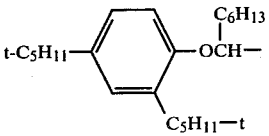 | 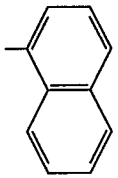 | —$NHSO_2CH_3$ |

-continued
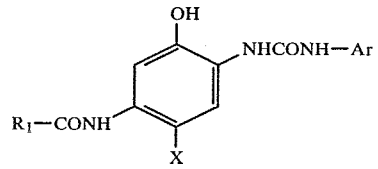
| | | | |
|---|---|---|---|
| C-21 | 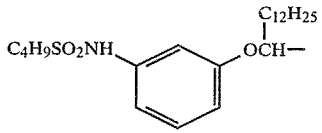 | 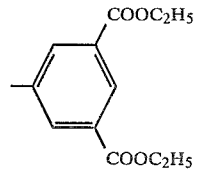 | 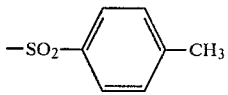 |
| C-22 | 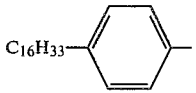 | 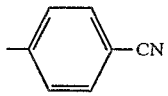 | 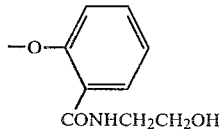 |
| C-23 | $C_{15}H_{31}$— | 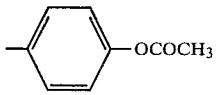 | —Cl |
| C-24 | 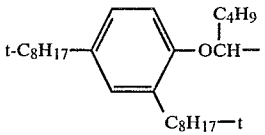 | 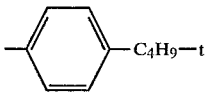 | 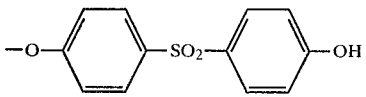 |
| C-25 | 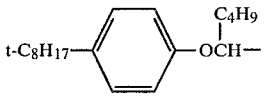 | 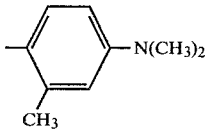 | 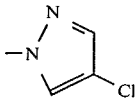 |

-continued
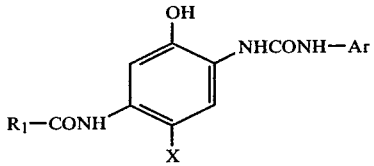
| | | | |
|---|---|---|---|
| C-26 | 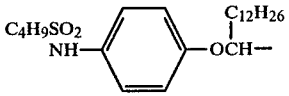 | 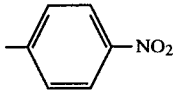 | 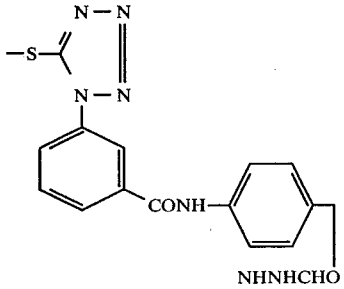 |
| C-27 | 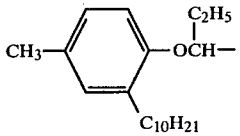 | 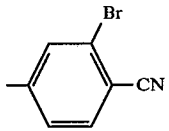 | —H |
| C-28 | 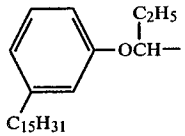 | 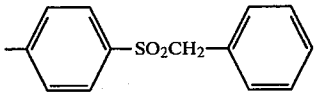 | —$OCH_2CH_2$ $CH_2COOH$ |
| C-29 | 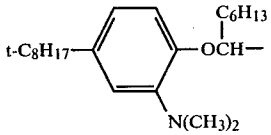 | 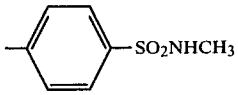 | —F |

-continued
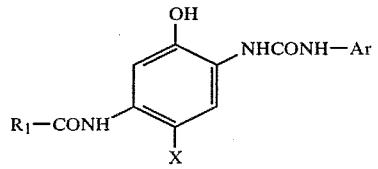
C-30
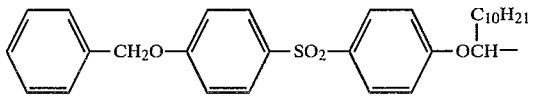
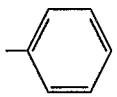
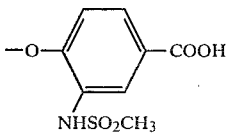
C-31
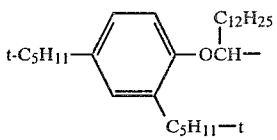
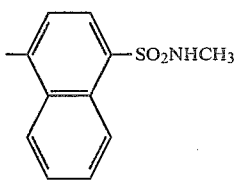
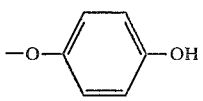
C-32
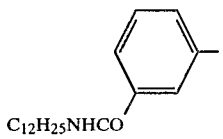
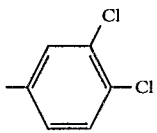
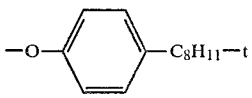
C-33
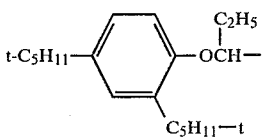
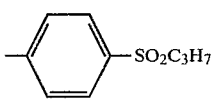
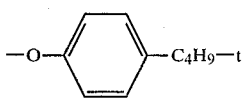
C-34
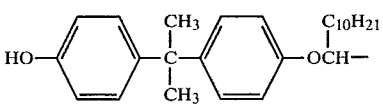
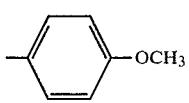
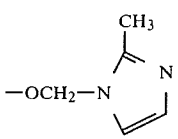

-continued
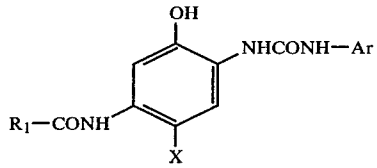
| | | | |
|---|---|---|---|
| C-35 | 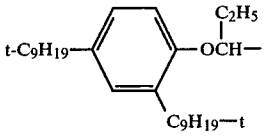 | 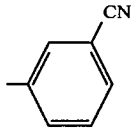 | —$OCH_2CH_2SO_2$ $CH_2CH_2COOH$ |
| C-36 | 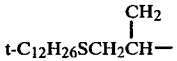 | 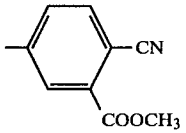 | 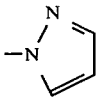 |
| C-37 | 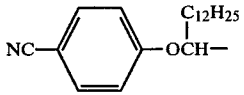 | 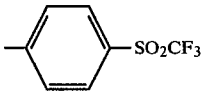 | 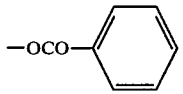 |
| C-38 | 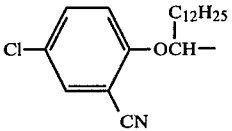 | 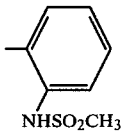 | —H |
| C-39 | 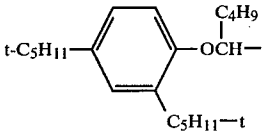 | 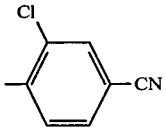 | 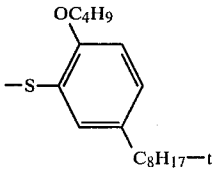 |

-continued
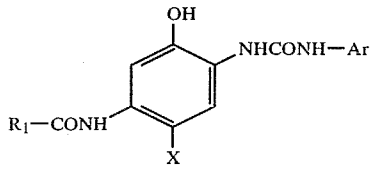
| | | | |
|---|---|---|---|
| C-40 | 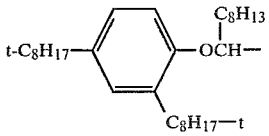 | 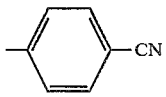 | —Cl |
| C-41 | 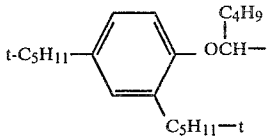 | 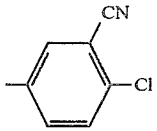 | —H |
| C-42 | 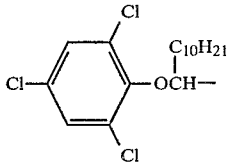 | 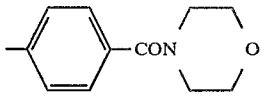 | 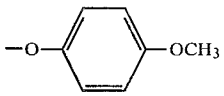 |
| C-43 | 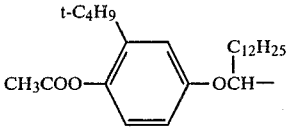 | 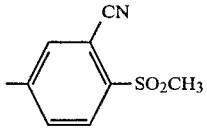 | 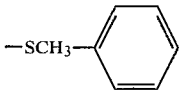 |
| C-44 | 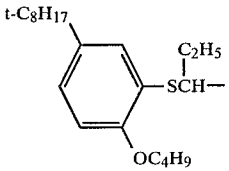 | 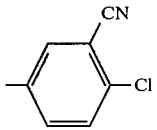 | —OCHCH=CH2 |

-continued
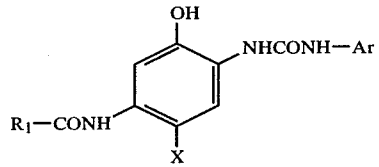
| | | | |
|---|---|---|---|
| C-45 | 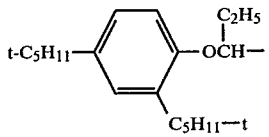 | 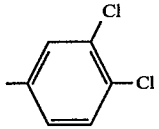 | —H |
| C-46 | 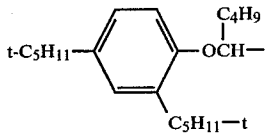 | 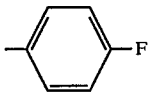 | 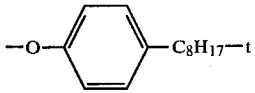 |
| C-47 | 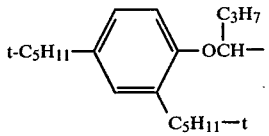 | 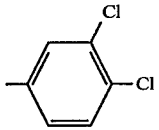 | 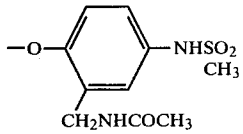 |
| C-48 | 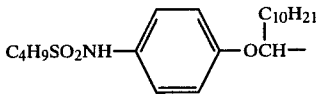 | 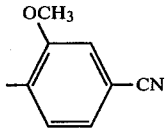 | 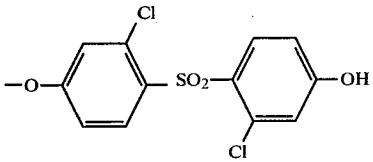 |
| C-49 | 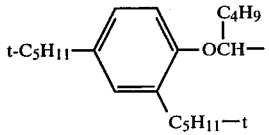 | 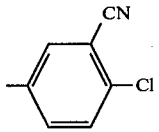 | 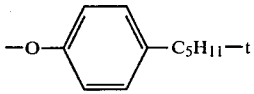 |

-continued
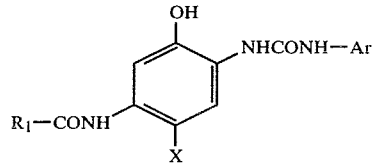
C-50
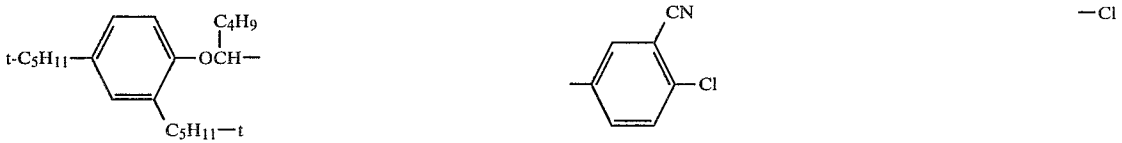
C-51
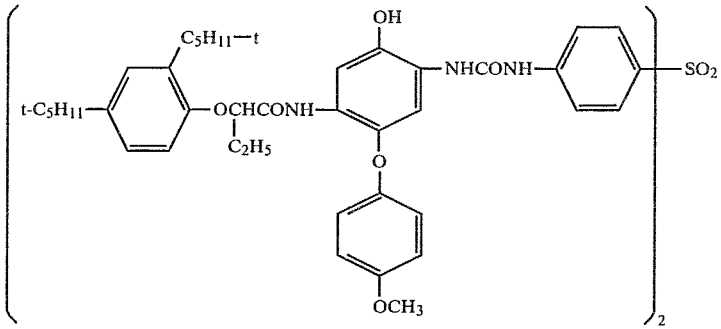
C-52
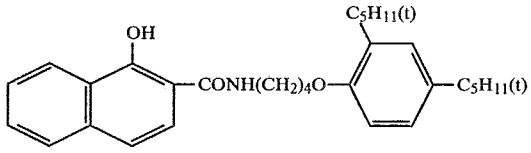
C-53
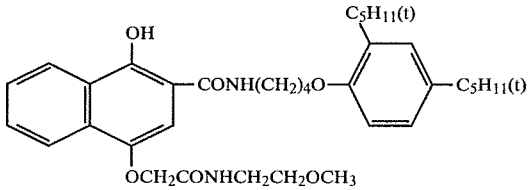

-continued
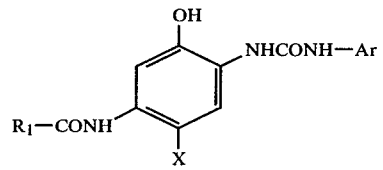
C-54
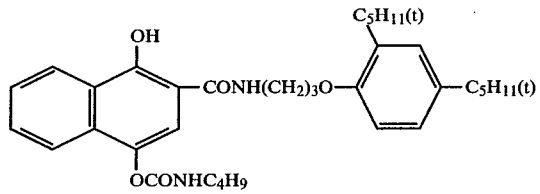
C-55
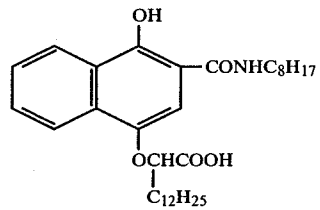
C-56
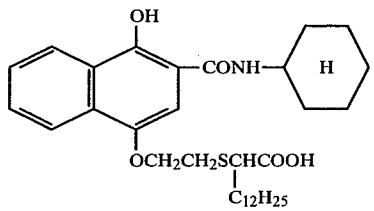
C-57
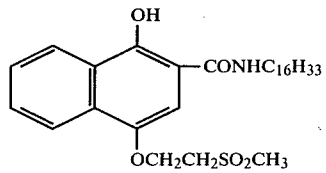

-continued
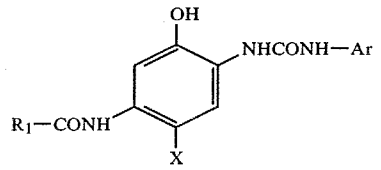
C-58
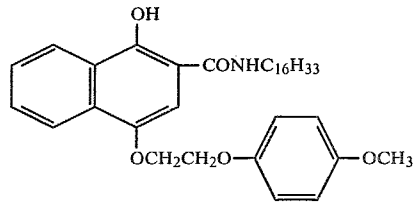
C-59
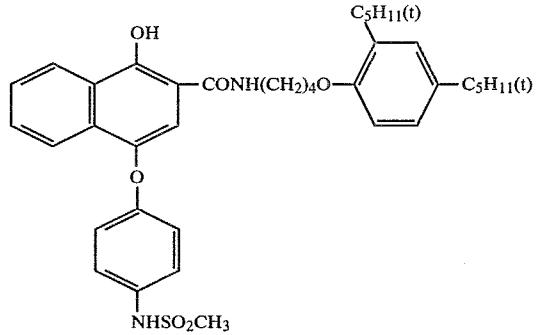
C-60
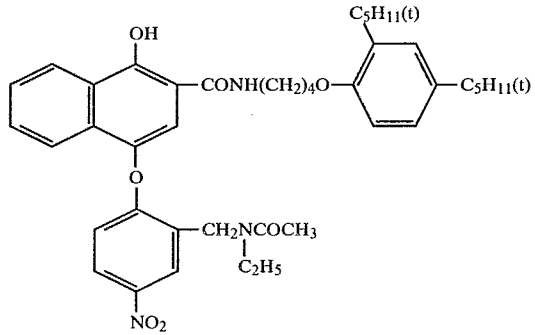

-continued
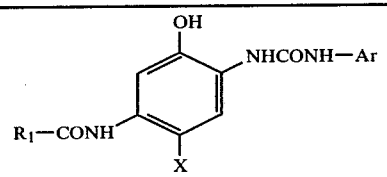
C-61
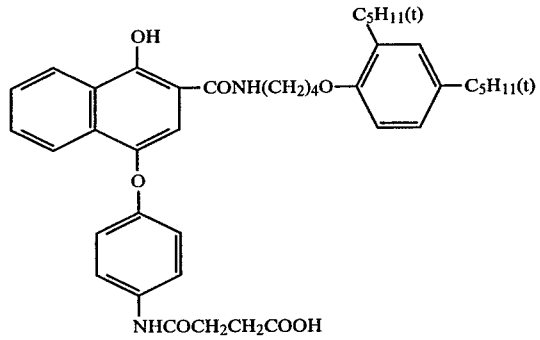
C-62
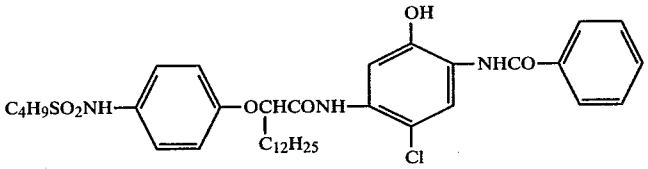
C-63
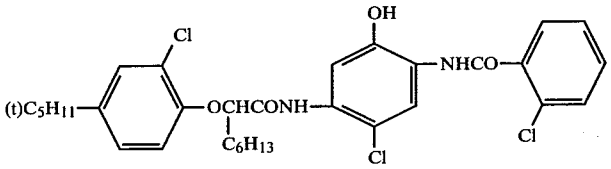
C-64
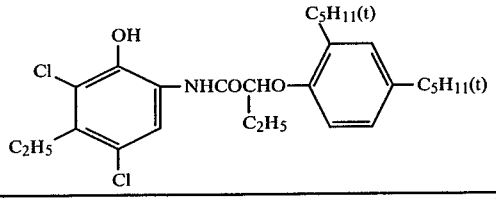

The above exemplified cyan couplers of this invention may be synthesized according to those methods described in Japanese Patent O.P.I. Publication Nos. 65134/1981, 204543/1982, 204544/1982, 204545/1982, 33249/1983, 33253/1983, 98731/1983, 118643/1983, 179838/1983, 187928/1983, 65844/1984, 71051/1984, 86048/1984, 105644/1984, 111643/1984, 111644/1984, 131939/1984, 165058/1984, 177558/1984, 180559/1984, 198445/1984, 35731/1985, 37557/1985, 49335/1985, 49336/1985, 50533/1985, 91355/1985, 107649/1985, 107650/1985, 2757/1986, 105226/1978, 109630/1978, 10135/1975, 117422/1975, 66129/1979, 32071/1980, 65957/1980, 1938/1981, 27143/1981 and 166956/1984, Japanese Patent Examined Publication No. 11572/1974, U.S. Pat. Nos. 2,474,293, 2,895,826 and 3,476,563.

The magenta coupler to be used in the green-sensitive emulsion layer of the color light-sensitive material of this invention includes so-called colorless couplers, colored couplers, DIR couplers, and the like.

The green-sensitive emulsion layer may be either a single layer or comprised of two or more layers, and is more desirable to be comprised of two or more layers different in the sensitivity.

For the silver halide emulsion of the color light-sensitive material of this invention such arbitrary silver halides for use in the preparation of ordinary silver halide emulsions as silver bromide, silver iodobromide, silver iodochloride, silver chlorobromide, silver chloroiodobromide, silver chloride, and the like, and particularly the silver halide is desirable to be silver bromide, silver iodobromide, and silver chloroiodobromide.

Silver halide grains to be used in the silver halide emulsion may be those obtained through any of the acid method, neutral method, and ammoniacal method. The grain may be one obtained by growing it at a time or one, after preparing a seed grain, obtained by growing the seed grain. The method of preparing the seed grain and the method of growing it may be either the same or different.

The silver halide emulsion may be obtained through the simultaneous mixing of halide and silver ions or through mixing one into a liquid where the other is present. Also, the grain may be grown in the manner that, taking into account the critical growth rate of silver halide crystals, halide and silver ions are intermittently, simultaneously poured into a mixing pot with its inside pH and pAg being controlled. By doing this, silver halide grains in the regular crystal form and of nearly uniform grain sizes can be obtained. In the arbitrary process of forming AgX, the conversion method may be used to change the halide composition of the grain.

During the growth of silver halide grains a known silver halide solvent such as ammonia, thioether, thiounrea, or the like may be made present.

To the silver halide grain may be added, in the course of forming and/or growing the grain, metallic ions by using at least one salt selected from the group consisting of cadmium salts, zinc salts, lead salts, thalium salts, iridium salts (including complex salts), rhodium salts (including complex salts), and iron salts (including complex salts) to thereby incorporate these metal elements into the inside and/or onto the surface of the grain, and the silver halide grain may be placed in an appropriate reductive atmoshere, whereby the inside and/or the surface of the grain can be provided with a reduction sensitization nucleus.

The resulting unnecessary water-soluble salts, after the growth of the silver halide grain, may be removed from the silver halide emulsion, or may remain unremoved. The removal of such salts may be performed in accordance with the method described in Item II of Research Disclosure (hereinafter abbreviated to R.D.) No. 17643.

The silver halide grain may be either one having thereinside a uniform silver halide composition distribution or a core/shell-type grain of which the inside and the surface stratum are different in the silver halide composition.

The silver halide grain may be one in which a latent image is formed mainly on its surface or one in which a latent image is formed mainly inside it.

The silver halide grain may be either one in the regular crystal form such as the cubic, octahedral or tetradecahedral form, or one in the irregular crystal form such as the spherical or tabular form. In these grain forms those having an arbitrary {100} face-{111} face ratio may be used. And the grain may be in the composit form of these crystal forms, and may also be a mixture of various crystal forms.

The usable mean grain size of such silver halide grains is from 0.05 to 30μ, and preferably from 0.1 to 20μ.

The silver halide emulsion used may be of any grain size distribution. A wide-grain-size-distribution emulsion (called polydisperse emulsion) may be used or narrow-grain-size-distribution emulsions (called monodisperse emulsion; the 'monodisperse emulsion' herein means one wherein when the standard deviation of its grain size distribution is divided by its mean grain size, the quotient is not more than 0.20, wherein the grain size, in the case of a spherical silver halide crystal, is its diameter, and, in the case of a nonspherical grain, is the diameter of a circular image equivalent in the area to its projection image) may be used alone or in a mixture thereof different in the distribution. The polydisperse emulsion and monodisperse emulsion may also be mixed to be used.

The silver halide emulsion may be a mixture of separately formed two or more different silver halide emulsions.

the silver halide emulsion may be chemically sensitized in usual manner. That is, the chemical sensitization may be made by using the sulfur sensitization method, selenium sensitization method, reduction sensitization method, noble metallic sensitization method, and the like.

The silver halide emulsion may be optically sensitized to a desirable wavelength resion by using dyes known as sensitizing dyes to the photographic industry. And supersensitizers may also be incorporated into the emulsion.

Those usable sensitizing dyes include cyanine dyes, merocyanine dyes, complex cyanine dyes, complex merocyanine dyes, holopolar cyanine dyes, hemicyanine dyes, styryl dyes and hemioxanol dyes.

The particularly useful dyes are cyanine dyes, merocyanine dyes, and complex merocyanine dyes.

To the silver halide emulsion, for the purpose of preventing the possible occurrence of a fog in the manufacturing process, during the storage or during the processing thereof or of keeping the photographic characteristics thereof stable, may be added compounds known as antifoggants or stabilizers during, upon completion of and/or after completion of the chemical ripening thereof.

Gelatin may be advantageously used as the binder (or protective colloide) for the silver halide emulsion. And hydrophilic colloidal materials such as gelatin derivatives, graft polymers of gelatin with other high molecular materials, other proteins, sugar derivatives, cellulose derivatives, and synthetic hydrophilic high-molecular materials such as homo- or co-polymers may also be used.

The photographic emulsion layers and other hydrophilic colloid layers of a light-sensitive material that uses the silver halide emulsion of this invention may be hardened by the use of one or two or more different hardening agents capable of cross-linking the molecule of the binder (or protective colloid) to enhance the layer strength. For example, aldehydes, N-methylol compounds, dioxane derivatives, active vinyl compounds, active halogen compounds, mucohalogenic acids, and the like may be used as the hardening agent.

To the silver halide emulsion layers and/or other hydrophilic colloid layers of the light-sensitive material may be added a plasticizer for the purpose of increasing the elasticity thereof. And, for the purpose of improving the dimensional stability, a water-insoluble or less-soluble synthetic polymer-dispersed product (latex) may be incorporated into such layers.

In the emulsion layers of the light-sensitive material, dye-forming couplers are used which are to form dyes in the coupling reaction thereof with the oxidized product of an aromatic primary amine developing agent in the color developing process.

These dye-forming couplers are desirable to have in the molecule thereof a group called the ballasting group having not less than 8 carbon atoms, which makes the coupler non-diffusible. These dye-forming couplers may be either four-equivalent or two-equivalent, and include colored couplers having a color-correction effect and compounds which release, as a result of the coupling reaction thereof with the oxidized product of a developing agent, photographically useful fragments such as development inhibitor, development accelerator, bleaching accelerator, developing agent, silver halide solvent, toning agent, hardener, fogging agent, antifoggant, chemical sensitizer, spectral sensitizer, and desensitizer. Of these the coupler which releases a development inhibitor in the developing process to improve the image sharpness and graininess is called a DIR coupler. In place of the DIR coupler, a DIR compound may also be used which, in the coupling reaction thereof with the oxidized product of a developing agent, formes a colorless compound and releases development inhibitor at the same time.

The DIR coupler and DIR compound used include those with which an inhibitor is directly compound at the coupling position thereof and those with which an inhibitor is combined through a divalent group at the coupling position thereof, the inhibitor being combined so as to be released by the intramolecular nucleophilic reaction or intramolecular electron-transfer reaction inside the group that is split off by the coupling reaction (these in the latter are called timing DIR coupler and timing DIR compound). As for the inhibitor, those which are well diffusible and also those which are less diffusible after the split-off may be used. Colorless couplers which effects the coupling reaction with the oxidized product of an aromatic primary amine developing agent but forms no dye (also called competitive couplers) may also be used in combination with these dye forming couplers.

Those known acylacetanilide-type couplers may be suitably used as the yellow color-forming coupler. Of these couplers the benzoylacetanilide-type and pivaloylacetanilide-type compounds are advantageous. Useful examples of the yellow color-forming coupler include those as described in, e.g., U.S. Pat. Nos. 2,875,057, 3,265,506, 3,408,194, 3,551,155, 3,582,322, 3,725,072 and 3,891,445, West German Pat. No. 1,547,868, West German OLS Pat. Nos. 2,219,917, 2,261,361 and 2,414,006, British Pat. No. 1,425,020, Japanese Patent Examined Publication No. 10783/1976, Japanese Patent O.P.I. Publication Nos. 26133/1972, 73147/1973, 6341/1975, 87650/1975, 123342/1975, 130442/1975, 21827/1976, 102636/1976, 82424/1977, 115219/1977 and 95346/1983.

As the magenta dye-forming coupler those known 5-pyrazolone-type couplers, pyrazolobenzimidazole-type couplers, pyrazolotriazole-type couplers, open-chain acylacetonitrile-type couplers, indazolone-type couplers and the like may be used. Useful examples of the magenta color-forming coupler include those as described in, e.g., U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German OLS Patent Nos. 2,408,665, 2,417,945, 2,418,959 and 2,424,467, Japanese Patent Examined Publication No. 6031/1965, Japanese Patent O.P.I. Publication Nos. 74027/1974, 74028/1974, 129538/1947, 60233/1975, 159336/1975, 20826/1976, 26541/1976, 42121/1977, 58922/1977 and 55122/1978, and Japanese Patent Application No. 110943/1980.

As the cyan dye-forming coupler phenol-type or naphthol-type couplers are generally used. Useful examples of the cyan color-forming coupler include those as described in, e.g., U.S. Pat. Nos. 2,423,730, 2,474,293, 2,801,171, 2,895,826, 3,476,563, 3,737,326, 3,758,308 and 3,893,044, Japanese Patent O.P.I. Publication Nos. 37425/1972, 10135/1975, 25228/1975, 112038/1975, 117422/1975, 130441/1975 and 98731/1983.

Of these dye-forming couplers, colored couplers, DIR couplers, DIR compounds, image stabilizers, anti-color stain agents, ultraviolet absorbing agents, brightening agents and the like, which all need not be absorbed into the surface of the silver halide crystal, those hydrophobic compounds may be subjected to various dispersion methods such as the solid dispersion method, latex dispersion method, oil-in-water-type emulsification dispersion method, and the like. These methods may be arbitrarily selected to be used according to the chemical structure and the like of those hydrophobic compounds like such couplers. As for the oil-in-water-type emulsification dispersion method, those conventionally known methods for dispersing hydrophobic additives such as couplers may be used, in which such an additive is usually dissolved into a high-boiling solvent having a boiling point of more than about 150° C., if necessary, in combination with a low-boiling and/or water-soluble organic solvent, and the solution is emulsifiedly dispersed with the use of a surfactant into a hydrophilic binder such as an aqueous gelatin solution by means of a stirrer, homogenizer, colloid mill, flow-jet mixer, ultrasonic disperser, or the like, and after that the dispersed mixture is added to an objective colloidal liquid. In the course of this procedure may be inserted a process for removing the low-boiling solvent from the dispersed liquid or simultaneously with the dispersion.

Usable solvents as the high-boiling solvent include those organic solvents not reacting with the oxidized product of a developing agent and having a boiling point of not less than 150° C., such as phenol derivatives, phthalic acid alkyl esters, phosphoric acid esters, citric acid esters, benzoic acid esters, alkylamides, fatty acid esters, trimesic acid esters, and the like.

With or in place of the high-boiling solvent, a low-boiling or water-soluble organic solvent may be used. Examples of the low-boiling, substantially water-insoluble organic solvent include ethyl acetate, propyl acetate, butyl acetate, butanol, chloroform, carbon tetrachloride, nitromethane, nitroethane, benzene, and the like.

In dispersing mechanically or ultrasonically into water a solution of a hydrophobic compound dissolved into a single low-boiling solvent or into a mixture thereof with a high-boiling solvent, a dispersion assistant may be used, which includes anionic surfactants, nonionic surfactants, cationic surfactants and amphoteric surfactants.

In order to prevent the occcurrence of color turbidity, deterioration of the image sharpness, and conspicuousness of grains caused by the transfer of the oxidized product of a developing agent or of an electron-transfer agent between the emulsion layers of the light-sensitive material, an anti-color stain agent may be used.

The anti-color stain agent may be incorporated into the emulsion layer itself or into an interlayer that is provided between the adjacent emulsion layers.

In the light-sensitive material may be used an image stabilizer for preventing a resulting dye image from being deteriorated.

The hydrophilic colloid layer such as the protective layer, intermediate layer, etc., of the light-sensitive material may contain an ultraviolet absorbing agent in order to prevent the possible fog due to the discharge of the static electricity frictionally charged on the light-sensitive material and also to prevent a resulting dye image from being deteriorated by ultraviolet rays.

A formalin scavenger may be used in the light-sensitive material in order to prevent the magenta dye-forming coupler and the like from being deteriorated by formalin during the storage of the light-sensitive material.

The silver halide emulsion layers and/or other hydrophilic colloid layers of the light-sensitive material may contain compounds capable of changing the developability such as development accelerator, development retarder, etc., and a bleaching accelerator.

The emulsion layer of the photographic light-sensitive material, for the purpose of increasing its speed and contrast and accelerating its development, may contain polyalkylene oxides or the derivatives thereof, thioether compounds, urethane derivatives, urea derivatives, imidazole derivatives, and the like.

The light-sensitive material may be provided with auxiliary layers such as filter layers, antihalation layer, antiirradiation layer, and the like. The silver halide emulsion layers and/or other hydrophilic colloid layers of the light-sensitive material may contain a matting agent for the purpose of reducing the gloss of the light-sensitive material, improving the retouchability, and preventing the adherence of the light-sensitive material to each other.

Any appropriate materials may be used as the matting agent. The matting agent grain size is preferably from 0.05μ to 10μ, and the adding amount of the agent is preferably from 1 to 300 mg/m$^2$.

In order to reduce the sliding friction, a lubricant may be added to the light-sensitive material.

An antistatic agent may be added to the light-sensitive material for the purpose of preventing static electricity.

Various surfactants may be used in the photographic emulsion layers and/or other hydrophilic colloid layers of the light-sensitive material for the purpose of improving the coatability, preventing the charging of static electricity, improving the slidableness, emulsification dispersibility, adherence preventability, and photographic characteristics such as of development acceleration, hardening and sensitization.

Although no particular restrictions are put on the surfactant, for example, natural surfactants, nonionic surfactants, cationic surfactants, acid group-containing anionic surfactants, or amphoteric surfactants may be added. And for the same purpose, fluoride-type surfactants may also be used.

In order to obtain a dye image with use of the light-sensitive material of this invention the material is exposed and then subjected to a color photographic processing. The color processing is made through the color developing process, bleaching process, fixing process, washing process, and, if necessary, stabilizing process. Instead of making both the bleaching process using a bleaching bath and the fixing process using a fixer bath, a monobath bleach-fix solution may be used to effect the bleach-fix process, or alternatively the monobath process using a monobath developing/bleaching/fixing solution which enables the color development, bleaching and fixing in a single bath may also be employed.

The processing usually takes place at a temperature of from 10° C. to 65° C., but is allowed to take place at a temperature of exceeding 65° C. The preferred processing temperature is from 25° C. to 45° C.

The color developer solution is usually an aqueous alkaline solution containing a color developing agent. The color developing agent is an aromatic primary amine color developing agent, which includes aminophenol-type and p-phenylenediamine-type drivatives. These color developing agents may be used in the form of salts of organic acids and inorganic acids, such as, for example, in the form of hydrochloride, sulfate, p-toluenesulfonate, sulfite, oxalate, benzenesulfonate, and the like.

These compounds may be used usually in a concentration of about 0.1 to 30 g per liter of a color developer solution, and more preferably about 1 to 15 g per liter of the color developer solution; in an amount of less than 0.1 g, no adequate color-developed density can be obtained.

The color developer solution to be used in this invention may contain those alkali agents as usually used in ordinary developer solutions, and may also contain various other additives such as benzyl alcohol, halogenated alkali metals, development control agents, preservatives, and the like, and further may arbitrarily contain various defoaming agents, surface active agents, organic solvents, oxidation inhibitors, and the like.

The pH of the color developer solution to be used in this invention is normally not less than 7, and preferably from about 9 to 13.

In the color developer solution to be used in this invention various chelating agents may be used in combination as the metallic ion blocking agent.

The bleaching process may take place simultaneously with the fixing process as stated above, and may also take place separately. As the bleaching agent, metallic complex salts of organic acids are used; for example, those complex salts of organic acids such as, e.g., polycarboxylic acids, aminopolycarboxylic acids, oxalic acid, citric acid, etc., in which metallic ions such as of iron, cobalt, copper, etc. are coordinated, may be used. Of the above organic acids the most preferred organic acids are polycarboxylic acids and aminopolycarboxylic acids.

These polycarboxylic acids may be in the form of alkali metallic salts, ammonium salts, or water-soluble amine salts. These bleaching agents may be used in a concentration of 5 to 450 g/liter, and more preferably 20 to 250 g/liter.

To the bleaching solution may be applied a composition containing, if necessary, a sulfite as a preservative and a bleaching accelerator in addition to the bleaching agent.

The bleaching solution is used at a pH of not less than 2.0, generally at a pH of from 4.0 to 9.5, preferably from 4.5 to 8.0, and most preferably from 5.0 to 7.0.

The fixer solution may be of a generally used composition. As the fixing agent those compounds used in ordinary fixing processes may be used, which react with silver halide to form water-soluble complex salts, typical examples of which include thiosulfates such as, e.g., potassium thiosulfate, sodium thiosulfate and ammonium thiosulfate; thiocyanates such as potassium thiocyanate, sodium thiocyanate and ammonium thiocyanate; and thiourea and thioether. These fixing agents each may be used in a concentration of not less than 5 g/liter and in the soluble amount range, and used generally in the range of from 70 to 250 g/liter. In addition, the fixing agent can be incorporated partially in a bleaching bath, and contrary to this, part of the bleaching agent also can be incorporated into the fixing bath.

Further, the bleaching bath and/or fixing bath may contain any of various pH buffers, and in addition may arbitrarily contain any of various brightening agents, defoaming agents, surface active agents, preservatives, organic chelating agents such as aminopolycarboxylic acids, stabilizers, hardening agents, organic solvents, and the like.

The fixing solution is used at a pH of not less than 3.0, generally from 4.5 to 10, preferably from 5 to 9.5, and most preferably from 6 to 9.

The bleaching agent to be used in the bleach-fix bath includes those metallic complex salts of the organic acids as defined in the above described bleaching process, and the preferred compounds and the concentration thereof in the processing liquid are also the same as defined in the above described bleaching process.

The bleach-fix bath may contain a silver halide fixing agent in addition to the foregoing bleaching agent, and also may, if necessary, contain a preservative.

The silver halide fixing agent which can be incorporated into the bleach-fix bath includes those fixing agents as described in the foregoing fixing process, and the cencentration of the fixing agent and the pH buffer and other additives to be incorporated in the bleach-fix bath are the same as those described in the foregoing fixing process.

The bleach-fix bath is used at a pH of not less than 4.0, generally from 5.0 to 9.5, preferably from 6.0 to 8.5, and most preferably from 6.5 to 8.5.

EXAMPLES

The following are examples of the present invention. The embodiments of the present invention are not restricted by the examples.

In all the following examples adding amounts to the silver halide photographic light-sensitive material are amounts per $m^2$ unless otherwise stated. As for the silver halide and colloidal silver, their amounts used are indicated in silver equivalent.

EXAMPLE 1

On a triacetyl cellulose film support were formed the following compositions-having layers in order from the support side, whereby a multilayered color photographic element sample 1 was prepared.

Sample 1 (comparative)

| | |
|---|---|
| Layer 1: | Antihalation layer (HC-1)<br>Black colloidal silver-containing gelatin layer. Dry thickness of the layer: 1.0 μm. |
| Layer 2: | Intermediate layer (I.L.)<br>Gelatin layer containing emulsifiedly dispersed 2,5-di-t-octyl-hydroquinone. Dry thickness of the layer: 0.8 μm. |
| Layer 3: | Low-speed red-sensitive silver halide emulsion layer (RL-1) comprising<br>monodisperse emulsion (Emulsion I) of AgBrI containing 6 mole % AgI with a mean grain size (r) of 0.30 μm: coating amount of silver 1.8 $g/m^2$,<br>Sensitizing Dye I: $6 \times 10^{-5}$ moles per mole of silver,<br>Sensitizing Dye II: $1.0 \times 10^{-5}$ moles per mole of silver,<br>Cyan Coupler (C-1): 0.06 mole per mole of silver,<br>Colored Cyan Coupler (CC-1): 0.003 mole per mole of silver,<br>DIR Compound (D-1): 0.0015 mole per mole of silver,<br>DIR Compound (D-2): 0.002 mole per mole of silver.<br>Dry thickness of the emulsion layer: 1.7 μm. |
| Layer 4: | High-speed red-sensitive silver halide emulsion layer (RH-1) comprising<br>monodisperse emulsion (Emulsion II) of AgBrI containing 7.0 mole % AgI with a mean grain size (r) of 0.5 μm: coating amount of silver 1.3 $g/m^2$,<br>Sensitizing Dye I: $3 \times 10^{-5}$ moles per mole of silver,<br>Sensitizing Dye II: $1.0 \times 10^{-5}$ moles per mole of silver,<br>Cyan Coupler (C-1): 0.02 mole per mole of silver,<br>Colored Cyan Coupler (CC-1): 0.0015 mole per mole of silver,<br>DIR Compound (D-2): 0.001 mole per mole of silver.<br>Dry thickness of the emulsion layer: 1.0 μm. |
| Layer 5: | Intermediate layer (I.L.)<br>Gelatin layer similar to Layer 2.<br>Dry thickness of the layer: 0.5 μm. |
| Layer 6: | Low-speed green-sensitive silver halide emulsion layer (GL-1) comprising<br>Emulsion-I: coating amount of silver: 1.5 $g/m^2$,<br>Sensitizing Dye III: $2.5 \times 10^{-5}$ moles per mole of silver,<br>Sensitizing Dye IV: $1.2 \times 10^{-5}$ moles per mole of silver,<br>Magenta Coupler (M-1): 0.050 mole per mole of silver,<br>Colored Magenta Coupler (CM-1): 0.009 mole per mole of silver,<br>DIR Compound (D-1): 0.0010 mole per mole of silver,<br>DIR Compound (D-3): 0.0030 mole per mole of silver.<br>Dry thickness of the layer: 2.5 μm. |
| Layer 7: | High-speed green-sensitive silver halide emulsion layer (GH-1) comprising<br>Emulsion II: coating amount of silver: 1.4 $g/m^2$,<br>Sensitizing Dye III: $1.5 \times 10^{-5}$ moles per mole of silver,<br>Sensitizing Dye IV: $1.0 \times 10^{-5}$ moles per mole of silver,<br>Magenta Coupler (M-1): 0.0020 mole per mole of silver,<br>Colored Magenta Coupler (CM-1): 0.002 mole per mole of silver, |

-continued

DIR Compound (D-3): 0.0010 mole per mole of silver.
Dry thickness of the layer: 1.5 μm.

Layer 8: Yellow filter layer (YC-1)
Gelatin layer containing yellow colloidal silver and an emulsifiedly dispersed product of 2,5-di-t-octylhydroquinone.
Dry thickness of the layer: 0.5 μm.

Layer 9: Low-speed blue-sensitive silver halide emulsion layer (BL-1) comprising
monodisperse emulsion (Emulsion III) of AgBrI containing 6 mole % AgI with a mean grain size of 0.48 μm: coating amount of silver: 0.9 g/m$^2$,
Sensitizing Dye V: $1.3 \times 10^{-5}$ moles per mole of silver,
Yellow Coupler (Y-1): 0.29 mole per mole of silver.
Dry thickness of the layer: 2.5 μm.

Layer 10: High-speed blue-sensitive silver halide emulsion layer (BH-1) comprising
monodisperse emulsion (Emulsion IV) of AgBrI containing 15 mole % AgI with a mean grain size of 0.8 μm: coating amount of silver: 0.5 g/m$^2$,
Sensitizing Dye V: $1.0 \times 10^{-5}$ moles per mole of silver,
Yellow Coupler (Y-1): 0.08 mole per mole of silver,
DIR Compound (D-2): 0.0015 mole per mole of silver.
Dry thickness of the layer: 1.0 μm.

Layer 11: First protective layer (Pro-1)
Gelatin layer comprising silver iodobromide (containing 1 mole % AgI) with a mean grain size of 0.07 μm: coating amount of silver: 0.5 g/m$^2$, and Ultraviolet Absorbing Agents UV-1 and UV-2.
Dry thickness of the layer: 2.0 μm.

Layer 12: Second protective layer (Pro-2)

-continued

Gelatin layer comprising polymethyl methacrylate particles (diameter 1.5 μm) and Formalin Scavenger (HS-1). Dry thickness of the layer: 1.0 μm.

Further, to each of the above layers were added Gelatin Hardener (H-1) and a surface active agent in addition to the above compositions.

The dry thickness of each layer was adjusted by controlling the amount of gelatin so as to be the above layer thickness (calculated value).

As a result, the total dry thickness of Sample 1 was 16 μm.

Measurement of the total dry thickness was made by using a commercially available contact-type thickness measuring instrument after the sample was conditioned at 23° C. / 55%RH for more than 24 hours.

The compounds incorporated into the respective layers of Sample 1 are as follows:

Sensitizing Dye I: Anhydro-5,5′-dichloro-9-ethyl -3,3′-di-(3-sulfopropyl)thiacarbocyanine hydroxide.

Sensitizing Dye II: Anhydro-9-ethyl-3,3′-di -(3-sulfopropyl)-4,5,4′,5′-dibenzothiacarbocyanine hydroxide.

Sensitizing Dye III: Anhydro-5,5′-diphenyl-9-ethyl-3,3′-di-(3-sulfopropyl)oxacarbocyanine hydroxide.

Sensitizing Dye IV: Anhydro-9-ethyl-3,3′-di-(3-sulfopropyl)-5,6,5′,6′-dibenzoxacarbocyanine hydroxide.

Sensitizing Dye V: Anhydro-3,3′-di-(3-sulfopropyl) -4,5-benzo-5′-methoxythiacyanine.

D-1

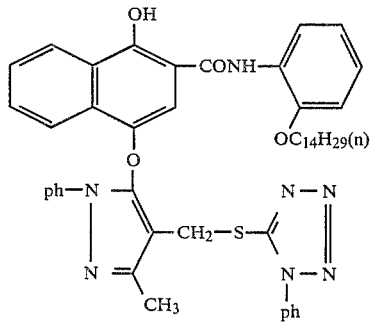

D-2

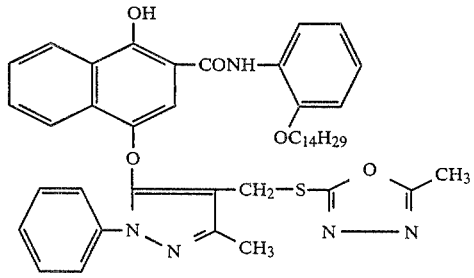

-continued
D-3
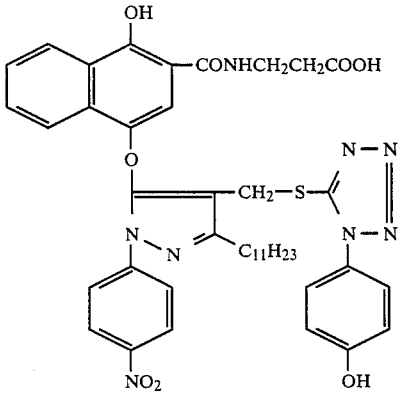
M-1
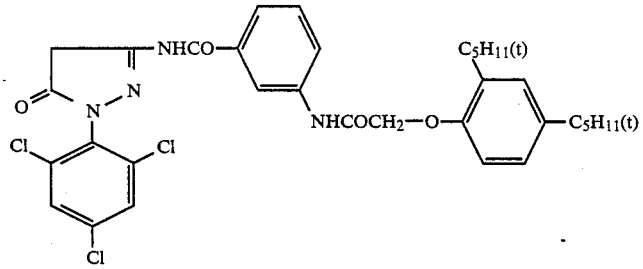
CM-1
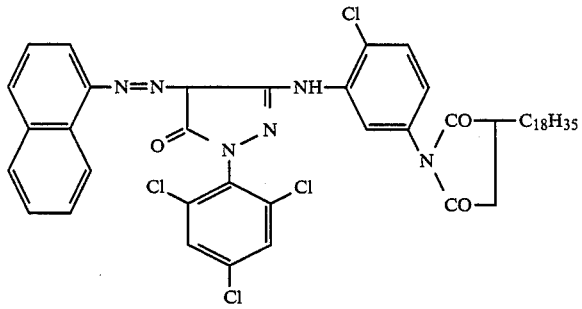
Y-1
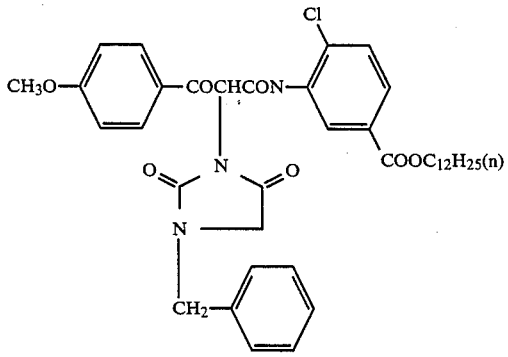
UV-1
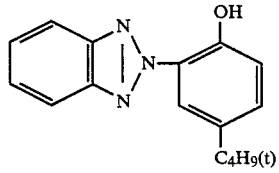
UV-2
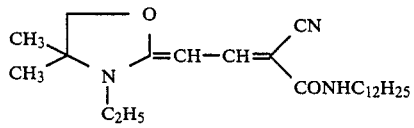

-continued

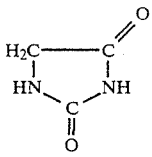

HS-1

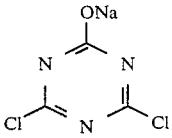

H-1

Samples 2 through 9 were prepared in the same manner as in Sample 1 except that the adding amount of the Layer 4's Colored Cyan Coupler (CC-1) was varied as shown in Table 1 (provided that Colorless Cyan Coupler (C-1) was decreased by the equal amout to that by which Colored Cyan Coupler (CC-1) was increased so that the total amount of the cyan couplers are constant). And Samples 10 through 13 were prepared in the same manner as in Sample 1 except that the total dry thickness of the layers was varied as shown in Table 1. The thickness of each layers were proportionaly increased by controlling an amount of gelatin contained therein.

The thus prepared Samples No. 1 through No. 13 each was exposed through an optical wedge, and then subjected to the following processings A through C.

| Processing Step (38° C.) | A | B | C |
|---|---|---|---|
| Color developing | 2 min. 45 sec. | 3 min. 15 sec. | 3 min. 45 sec. |
| Bleaching | | 6 minutes and 30 seconds | |
| Washing | | 3 minutes and 15 seconds | |
| Fixing | | 6 minutes and 30 seconds | |
| Washing | | 3 minutes and 15 seconds | |
| Stabilizing | | 1 minute and 30 seconds | |
| Drying | | | |

The compositions of the processing solutions that were used in the respective processes are as follows:

[Color Developer Solution]

| | |
|---|---|
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Add water to make 1 liter. | |

[Bleaching Solution]

-continued

| | |
|---|---|
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Add water to make 1 liter. Use ammonia water to adjust the pH to 6.0. | |

[Fixer Solution]

| | |
|---|---|
| Ammonium thiosulfate | 175.0 g |
| Anhydrous sodium sulfite | 8.5 g |
| Sodium metabisulfite | 2.3 g |
| Add water to make 1 liter. Use acetic acid to adjust the pH to 6.0. | |

[Stabilizer Solution]

| | |
|---|---|
| Formalin (aqueous 37% solution) | 1.5 ml |
| Koniducks (manufactured by Konishiroku Photo Industry Co., Ltd.) | 7.5 ml |
| Add water to make 1 liter. | |

Subsequently, the processed samples each was measured with respect to its optical densities by means of a commercially available densitometer to prepare characteristic curves. As for the red and green densities, Density $D_{1.0}$ in the position of the exposure range $\Delta\log E=1.0$ from the position of $D_{min+0.2}$ was found, and γ (gamma) was obtained from the value.

$$\gamma = \frac{D_{1.0} - D_{min+0.2}}{1.0}$$

Subsequently, γR/γG, the ratio of the gamma (γR) in the red density to the gamma (γG) in the green density, was found, and in the processes A through C, the $(\gamma R/\gamma G)_A/(\gamma R/\gamma G)_B$ ratio and the $(\gamma R/\gamma G)_C/(\gamma R/\gamma G)_B$ ratio on condition that the γR/γG for the developing time 3 minutes and 15 seconds (B) is regarded as 1.00 were found. The results are shown in Table 1.

TABLE 1

| No. | Adding amt. of CC-1 × $10^3$ (mol/AgI mol) | CC-1's ratio (mol) to all the cyan couplers in Layer 4 | Total dry thickness (μm) | γR/γG ratio in each developing time when the γR/γG for 3 min. 15 sec. development is regarded as 1.00. 2 min. 45 sec. | 3 min. 15 sec. | 3 min. 45 sec. |
|---|---|---|---|---|---|---|
| 1 | 1.500 | 6.7% (comparative) | 16 | 0.74 | 1.00 | 1.28 |
| 2 | 2.925 | 13% (comparative) | 16 | 0.77 | 1.00 | 1.25 |
| 3 | 4.050 | 18% (invention) | 16 | 0.90 | 1.00 | 1.09 |
| 4 | 5.175 | 23% (invention) | 16 | 0.93 | 1.00 | 1.06 |
| 5 | 6.300 | 28% (invention) | 16 | 0.98 | 1.00 | 1.02 |
| 6 | 9.000 | 40% (invention) | 16 | 0.98 | 1.00 | 1.01 |
| 7 | 13.50 | 60% | 16 | 0.99 | 1.00 | 1.02 |

TABLE 1-continued

| No. | Adding amt. of CC-1 × $10^3$ (mol/AgI mol) | CC-1's ratio (mol) to all the cyan couplers in Layer 4 | Total dry thickness (μm) | γR/γG ratio in each developing time when the γR/γG for 3 min. 15 sec. development is regarded as 1.00. 2 min. 45 sec. | 3 min. 15 sec. | 3 min. 45 sec. |
|---|---|---|---|---|---|---|
| | | (invention) | | | | |
| 8 | 16.88 | 75% (invention) | 16 | 0.93 | 1.00 | 1.05 |
| 9 | 19.13 | 85% (comparative) | 16 | 0.83 | 1.00 | 1.18 |
| 10 | 9.000 | 40% (invention) | 10 | 0.98 | 1.00 | 1.01 |
| 11 | 9.000 | 40% (invention) | 14 | 0.97 | 1.00 | 1.02 |
| 12 | 9.000 | 40% (comparative) | 19 | 0.82 | 1.00 | 1.20 |
| 13 | 9.000 | 40% (comparative) | 25 | 0.76 | 1.00 | 1.21 |

As is apparent from Table 1, Samples 3 through 8, 9 and 10 of this invention are remarkably improved in the processing stability.

EXAMPLE 2

Samples 14 through 23 were prepared in the same manner as in Sample 5 of Example 1 except that the colored coupler and colorless coupler of Sample 5 were varied as shown in Table 2.

The samples were then processed in the same manner as in Example 1, and the $(\gamma R/\gamma G)_A/(\gamma R/\gamma G)_B$ and $(\gamma R/\gamma G)_C/(\gamma R/\gamma G)_B$ for each sample were obtained. The results are shown in Table 2.

TABLE 2

| No. | Colorless coupler | Colored coupler | γR/γG ratio for each developing time when the γR/γG in 3 min. 15 sec. development is regarded as 1.00 2 min. 45 sec. | 3 min. 15 sec. | 3 min. 45 sec. |
|---|---|---|---|---|---|
| 14 | C-41 | CC-9 | 0.98 | 1.00 | 1.02 |
| 15 | C-41 | CC-6 | 1.00 | 1.00 | 1.00 |
| 16 | C-41 | CC-13 | 0.99 | 1.00 | 1.00 |
| 17 | C-41 | CC-10 | 0.98 | 1.00 | 1.01 |
| 18 | C-41 | CC-1 | 0.97 | 1.00 | 1.02 |
| 19 | C-8 | CC-1 | 0.98 | 1.00 | 1.00 |
| 20 | C-53 | CC-1 | 0.99 | 1.00 | 1.02 |
| 21 | C-5 | CC-1 | 0.98 | 1.00 | 1.01 |
| 22 | C-5 | CC-9 | 0.99 | 1.00 | 1.01 |
| 23 | C-9 | CC-9 | 0.99 | 1.00 | 1.02 |

As is apparent from Table 2, Samples 14 through 23 are remarkably improved in the processing stability just as the Sample 5 of Example 1 is.

What is claimed is:

1. A silver halide color photographic light-sensitive material comprising a support having, on a side thereof, plural layers including at least one red-sensitive silver halide emulsion layer and at least one green-sensitive silver halide emulsion layer, in which the total thickness in a dry state of said plural layers is within the range of from 5 to 18 μm, and said red-sensitive silver halide emulsion layer contains a non-diffusible cyan-dye forming coupler and a colored non-diffusible cyan-dye forming coupler and a ratio of said colored non-diffusible cyan-dye forming coupler to the total amount of said non-diffusible cyan-dye forming coupler and said colored cyan dye-forming coupler is within the range of from 15 to 80 mole %.

2. The silver halide color photographic light-sensitive material of claim 1, wherein said ratio of said colored non-diffusible cyan-dye forming coupler to the total amount of said cyan dye-forming coupler and said colored non-diffusible cyan-dye forming coupler is within the range of from 20 to 70 mole %.

3. The silver halide color photographic light-sensitive material of claim 2, wherein said ratio of said colored non-diffusible cyan-dye forming coupler to the total amunont of said non-diffusible cyan-dye forming coupler and said colored non-diffusible cyan-dye forming coupler is within the range of from 25 to 60 mole %.

4. The silver halide color photographic light-sensitive material of claim 1, wherein said total thickness in a dry state of said plural layers is within the range of from 10 to 16 μm.

5. The silver halide color photographic light-sensitive material of claim 1, wherein said colored non-diffusible cyan-dye forming coupoler is represented by the following Formula [I].

Formula [I]

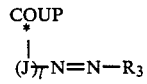

wherein COUP is a residue of cyan dye-forming coupler, * is a coupling portion of said coupler residue, J is a divalent bonding group being capable of splitting off from said coupler residue upon a reaction of said coupler residue with an oxidized product of a color developing agent, l is an integer 0 or 1 and $R_3$ is an aryl group.

* * * * *